United States Patent [19]

Riley

[11] 3,944,074

[45] Mar. 16, 1976

[54] CAN PACKAGING

[76] Inventor: Phillip J. Riley, 11190 Morrine Drive, Palos Hills, Ill. 60465

[22] Filed: Aug. 29, 1974

[21] Appl. No.: 501,679

[52] U.S. Cl. ..... 206/427; 206/150; 206/504; 220/23.4

[51] Int. Cl.[2] ..... B65D 71/00; B65D 21/02

[58] Field of Search ..... 206/427, 150, 504; 220/23.4; 215/10

[56] References Cited

UNITED STATES PATENTS

| | | | |
|---|---|---|---|
| 2,812,099 | 11/1957 | Eugan | 220/23.4 |
| 2,819,594 | 1/1958 | Lorie | 206/427 X |
| 3,038,599 | 6/1962 | Poupitch | 220/23.4 X |
| 3,167,458 | 1/1965 | Brazell | 220/23.4 UX |
| 3,330,408 | 7/1967 | Wanderer | 206/150 |
| 3,341,053 | 9/1967 | Keene | 206/504 X |
| 3,369,658 | 2/1968 | Hasselmann | 220/23.4 X |
| 3,683,549 | 8/1972 | Simmon | 220/23.4 X |
| 3,690,453 | 9/1972 | Dorall | 206/433 |

*Primary Examiner*—Leonard Summer
*Attorney, Agent, or Firm*—Darbo, Robertson & Vandenburgh

[57] ABSTRACT

A can package is formed by having interdigitating bumps and depressions on the cans which lock the cans against axial movement with respect to each other. A plastic band about the periphery of the group of cans holds the cans in that locked condition.

9 Claims, 4 Drawing Figures

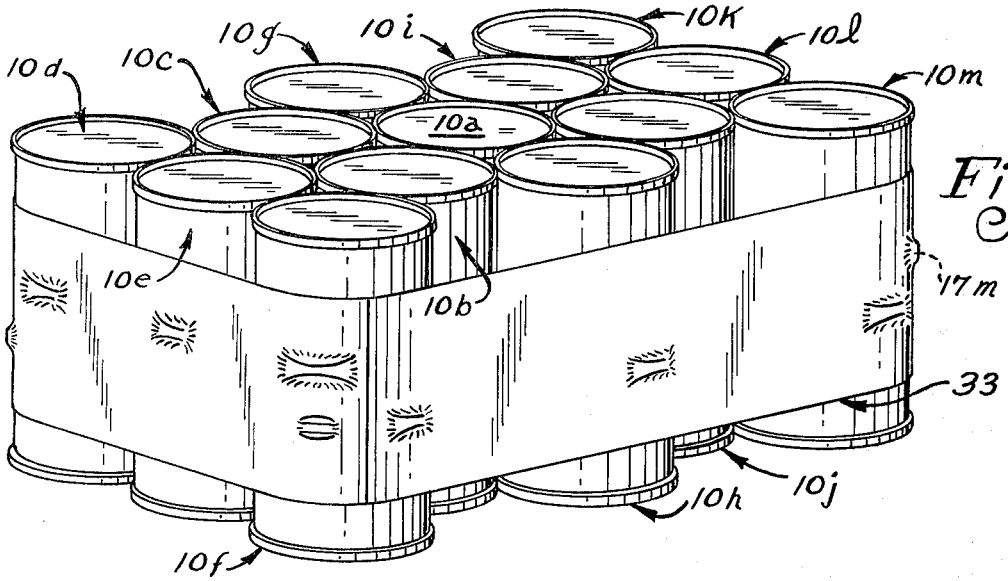
Fig. 1
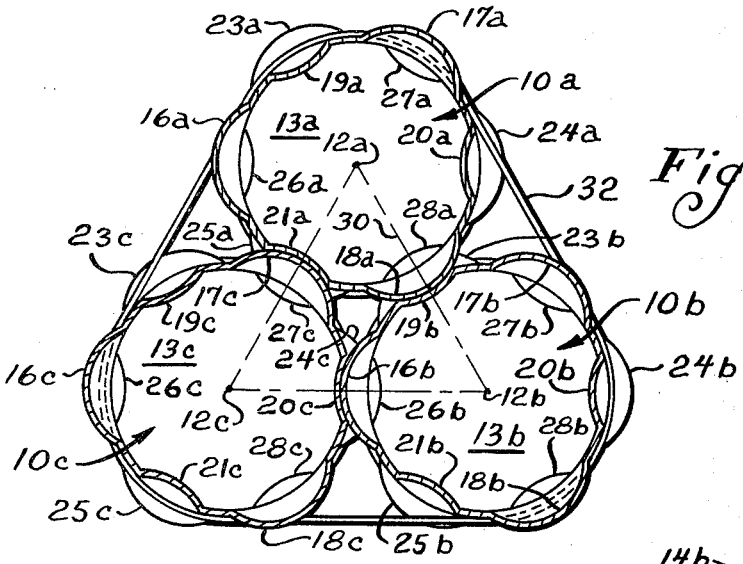
Fig. 3
Fig. 4
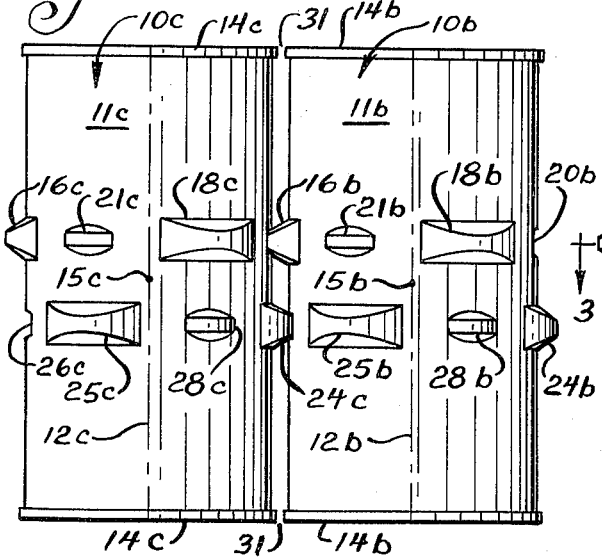
Fig. 2
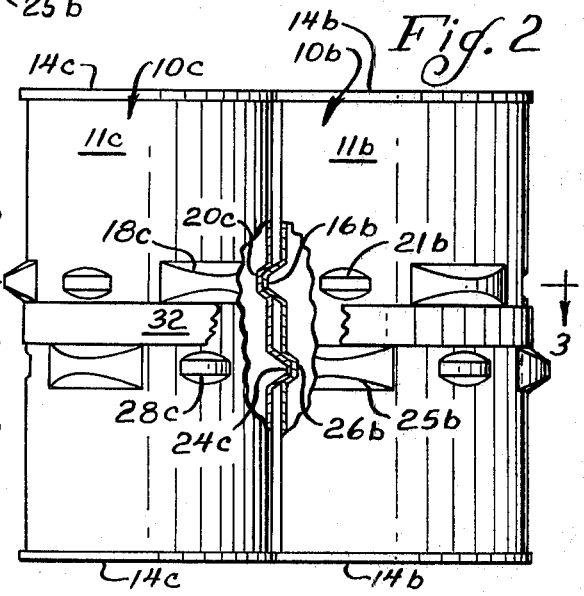

CAN PACKAGING

BACKGROUND AND SUMMARY OF THE INVENTION

The conventional procedure for packaging cans or the like for transportation from one location to another involves the use of cardboard boxes in which a specific number (i.e., a group) of cans are held. Such form of packaging has a number of disadvantages. For example, in the aggregate it requires vast amounts of raw materials, i.e., pulp to form the cardboard. There is the cost of manufacturing the cardboard and converting it into boxes. The boxes, even in folded form, require substantial shipment and storage space before the boxes are employed to package the cans. At the location at which the members of the group are to be separated, the box must be opened. And, last but not least, the cardboard must be disposed of after the box has served its purpose in connection with the transporting of the cans to the location at which the group is separated.

While some limited amount of packaging of cans is performed by putting a plastic band or cap about one end of each member of the group, as in a six-pack of beer cans, this is not entirely suitable for universal application.

The principal object of the present invention is to provide a way of holding a group of objects, such as cylindrical cans, together as a group for transportation from one location to another, which is comparatively simple and inexpensive and will securely hold the objects together so that the group can be handled as a unit without the possibility of the members of the group becoming displaced from each other. The invention has the important advantage that the package does not require substantial additional amounts of raw material as in the case of a cardboard carton, nor is there a substantial amount of packaging material to be disposed of once the group of objects is to be broken up, i.e., the cans separated. This is accomplished by interdigitating protrusions and depressions on the individual objects so as to lock them together against axial displacement and banding the group so as to hold them in that interdigitated condition.

Further objects and advantages will become apparent from the following description.

DESCRIPTION OF THE DRAWINGS

FIG. 1 is a perspective view of a package formed in accordance with the present invention, using a relatively wide exterior band;

FIG. 2 is an elevational view of a basic group of three cans using a relatively narrow band about the exterior of the group;

FIG. 3 is a section as viewed at line 3—3 of FIG. 2; and

FIG. 4 is an elevational view, as seen in FIG. 2, of the cans before banding.

DESCRIPTION OF SPECIFIC EMBODIMENT

The following disclosure is offered for public dissemination in return for the grant of a patent. Although it is detailed to ensure adequacy and aid understanding, this is not intended to prejudice that purpose of a patent which is to cover each new inventive concept therein no matter how others may later disguise it by variations in form or additions or further improvements.

In the present invention each can is identical and has a plurality of protrusions and depressions. The protrusions and depressions are arranged so that when the cans are placed side by side, with their longitudinal axes parallel, the protrusions of one can will fit into the depressions of the adjacent cans and vice versa. While a basic group of four cans could be employed, I prefer an embodiment where the basic group consists of three cans. That is, there are three cans which are positioned so that their axes are at the corners of an equilateral triangle. The walls of each can of the three abut the walls of the other two cans. The walls, of course, have the interdigitating protrusions and depressions which lock the cans against axial displacement with respect to each other so long as the contact between the cans is maintained. In referring to the basic group as one of three, this is not to say that each package must be limited to three cans for any additional number of cans can be added to the basic group to make up the overall package unit. In the overall unit all of the cans are arranged with respect to the adjacent cans so as to form a basic unit of three as just described. This basic unit will now be described with respect to FIGS. 2–4.

In the basic unit there are three identical cans, generally 10*a*, 10*b* and 10*c*. Each can has an outside wall 11*a*, 11*b*, 11*c* which walls are generally cylindrical about axes 12*a*, 12*b*, 12*c*. The cans have end walls 13*a*, 13*b* and 13*c* which, with the sidewalls, define rims 14*a*, 14*b* and 14*c*. The can walls are formed of metal. As thus far described, the cans are conventional.

Each can has a plurality of protrusions and depressions, which protrusions and depressions are positioned in two planes or rows normal to the cylindrical axis, one plane being above the mid-point (15*b* and 15*c* in FIG. 4) of that axis and the other plane being below the mid-point of that axis when the axis is vertically aligned. Thus in can 10*b* there are protrusions 16*b*, 17*b* and 18*b* and depressions 19*b*, 20*b* and 21*b* all positioned in one common plane and protrusions 23*b*, 24*b* and 25*b* and depressions 26*b*, 27*b* and 28*b* all positioned in a second common plane. The remaining cans 10*a* and 10*c* have identical protrusions and depressions. It will be noted that the protrusions in one plane are above the depressions in the other plane and vice versa. Thus, protrusions 16*b* in the upper plane (as viewed in the drawings) is above the depression 26*b* in the lower plane, etc. In the embodiment in which the basic group of objects, e.g., cans is three, the two depressions at each side of a protrusion are positioned so that their center lines are 60° from the center line of the protrusion. Thus, the center line of protrusion 16*b* is 60° from the center line of depressions 19*b* and 21*b*. Similarly, the angular distance from the center line of a depression is 60° from the center line of the two adjacent protrusions. Thus, any three adjacent cans can be positioned so that their axes 12*a*, 12*b* and 12*c* are at the corners of an equilateral triangle as represented by dot-dash line 30. Where the basic group to be one of four cans, rather than three as described, the angle between such adjacent conformations would be 90°.

When packaging objects such as cans which have at least semi-resilient walls, it is preferred that the configuration of the protrusions and the depressions is such that the protrusions seat in the depressions before the objects are otherwise in immovable contact with each other. Thus, it will be seen in FIG. 4, that the protrusions 16*b* and 24*c* have seated into the depression 20*c* and 26*b* respectively even though there is a slight space 31 between the rims 14 of the can. When the band 32 is put into place and secured, the cans are drawn together so that this space no longer exists, as seen in FIG. 2. The resiliency of the can walls permits this tightening of the package, i.e., the elimination of space 31. The can walls thus act as springs tending to hold the cans into tight engagement with each other and with the band 32.

As is apparent from the drawings, the protrusions and depressions have corresponding configurations, but the protrusions are longer than the depressions. The protrusions and depressions both are larger at their proximal end, which is at the otherwise cylindrical wall of the can, than at their distal end, the distal end being smaller than the proximal end both vertically (i.e., parallel to the can axis) and horizontally. The wall of one can along its protrusion meets the wall of another can within its depression so that, because of this wall to wall contact, neither can move sidewise or axially, nor can one rotate with respect to the other, so long as the band holds the two together.

I prefer to use a band 32 of a heat sealable plastic. Thus, when the ends of a band are overlapped and while they are being held securely together and in the proper tension, they are heated and cooled so as to form a bonded jont and securely affix the band in place. Various forms of heating known to those skilled in the art may be employed, such as dielectric heating, ulrasonic heating, etc. The band could be a continuous elastic strip which is slipped about the group of cans while they are otherwise being held in the desired orientation. Other forms of bands can be employed such as metal strapping, strips of paper, etc.

In most applications, a relatively narrow band positioned only between the upper and lower rows of protrusions will be adequate. Such a band 32 is illustrated in FIG. 2. The band should completely fill the space between the upper and lower rows of protrusions so that it abuts the protrusions, thus the protrusions prevent any relative movement of the band with respect to a can in a direction parallel to the cylindrical axis of the cans. In some applications it may be desirable to use a more secure banding. Such an embodiment is illustrated in FIG. 1 wherein there is a relatively wide band 33 which has portions both above and below the upper and lower rows of protrusions respectively. Band 33 is a plastic band and is drawn sufficiently tight so that the protrusions extend into the band in a manner such as to form pockets in the plastic, which pockets receive the protrusions. Thus, in the upper right hand corner of FIG. 1, it will be seen how the protrusion 17m of can 10m has formed a pocket in the band 33. The interlocking between the cans and the band thus obtained aids in retaining the group of cans as a unit.

FIG. 1 further illustrates how a substantial number of cans may be assembled into a shipping unit, with all of the cans of the unit forming groups of three. Thus, there is the group of three comprising cans 10*a*, 10*b* and 10*c* as described in connection with FIGS. 2–3. Adding can 10*h*, for example, could complete a unit or package of four. In the FIG. 1 unit the cans 10*a*, 10*b* and 10*h* also form one of the basic groups of three cans; cans 10*b*, 10*e* and 10*f* form one of the basic groups of three; etc.

Band 33 in FIG. 1, as previously mentioned, has portions above and below the upper and lower rows of protrusions. In some embodiments these upper and lower portions of the band could be separate bands without a central interconnection as illustrated in FIG. 1. In some applications a single row of protrusions and depressions could be employed in conjunction with a relatively wide band.

I claim:

1. A can having an annular protuberance at each end and having a longitudinal axis and external walls of generally cylindrical configuration, which can is to be assembled with other like cans to form a group of abutting cans in which the cans have their axes parallel and held in assembled arrangement by a band about the group, which group is to be transferred from one location to another, said can being characterized by having:

a plurality of regularly arranged protrusions and depressions in said wall, each protrusion extending outwardly from said generally cylindrical wall and each depression extending inwardly from said generally cylindrical wall in the form of a socket for receiving a protrusion, said protrusions and depressions having proximal ends at said generally cylindrical wall, said protrusions and depressions being so positioned that when the cans are assembled in said group one object of each pair of abutting objects has a protrusion which extends into a depression of the other object of the pair, thereby preventing movement of the objects of the pair with respect to each other in a direction generally parallel to said axes so long as said objects are maintained in said abutting relationship by said band, thereby preventing the cans of said group from moving, with respect to each other, in a direction transverse to said axes, the protrusion extending farther in a radial direction from said wall than said annular protuberances and sufficiently far beyond the wall so that the protrusion will seat in the depression of an adjacent can of said group before annular protuberances of the two come into contact, whereby when the cans are tightly banded together the can walls act as springs tending to hold the cans in engagement with each other and with the band.

2. A can as set forth in claim 1, wherein each protrusion is between two depressions an vice versa, and the centers of an adjacent protrusion and depression are spaced from each other by an angle of 60° measured about said axis.

3. An object as set forth in claim 1, wherein said protrusions and depressions are positioned in two planes normal to said axis, one plane being above the mid-point of said axis and the other plane bein below the mid-point of said axis when said axis is vertically aligned, wherein each protrusion in one plane being vertically aligned with a depression in the other plane and each depression in said one plane being vertically aligned with a protrusion in said other plane.

4. An assembly of a group of objects held as a unit to facilitate the movement of the group from one location to another, each object having an axis and an external wall of generally cylindrical configuration thereabout, each object being a can having annular protuberances at each end which extend outwardly from the generally cylindrical wall, said assembly comprising:

each object having a plurality of regularly arranged protrusions and depressions in said wall, said protrusion extending outwardly from said generally cylindrical wall and each depression extending inwardly from said generally cylindrical wall in the form of a socket for receiving a protrusion, said protrusions and depressions having proximal ends at said generally cylindrical wall, said protrusions and depressions being smaller, both vertically and horizontally, at their distal ends than at their proximal ends, said protrusions and depressions being so positioned that when the objects are assembled in said group one object of each pair of abutting objects has a protrusion which extends into a depression of the other object of the pair, the part of the wall defining the depression fitting closely about the distal end of the protrusion of the other object of the pair, thereby preventing movement of the objects of the pair with respect to each other in a direction generally parallel to said axis; and a band about said group holding the objects of the group in said abutting relationship thereby preventing movement of one object of the group with respect to the remaining objects of the group in a direction transverse to said axis;

the protrusion of one can extending sufficiently far beyond the wall so as to seat in the depression of a corresponding can before the annular protuberances of the two come into contact, said band being sufficiently tight to hold said annular protuberances of said cans in contact with one another, whereby when the cans are tightly banded together the can walls act as springs tending to hold the cans in engagement with each other and with the band.

5. An assembly as set forth in claim 4, wherein in each object each protrusion is between two depressions and vice versa, and the centers of an adjacent protrusion and depression are spaced from each other by an angle of 60° measured about said axis; and the objects of the group are so arranged with respect to each other so that each object abuts at least two other objects and the three objects so abutting are positioned so that their axes are at the corners of an equilateral triangle.

6. An assembly as set forth in claim 5, wherein in each object said protrusions and depressions are positioned in two planes normal to said axis, one plane being above the mid-point of said axis and the other plane being below the mid-point of said axis when said axis is vertically aligned; and said band encompasses the space between said two planes.

7. An assembly as set forth in claim 9, wherein in each object said protrusions and depressions are positioned in two planes normal to said axis, one plane being above the mid-point of said axis and the other plane being below the mid-point of said axis when said axis is vertically aligned; and said band encompasses the space between said two planes.

8. An assembly as set forth in claim 7, wherein in each object each protrusion in one plane is vertically aligned with a depression in the other plane and each depression in said one plane is vertically aligned with a protrusion in said other plane.

9. An assembly as set forth in claim 4, wherein in each object said protrusions and depressions are positioned in two planes normal to said axis, one plane being above the mid-point of said axis and the other plane being below the mid-point of said axis when said axis is vertically aligned; and said band includes portions at opposite sides of said two planes.

* * * * *

UNITED STATES PATENT OFFICE

CERTIFICATE OF CORRECTION

Patent No. 3,944,074 Dated March 16, 1976

Inventor(s) Phillip J. Riley

It is certified that error appears in the above-identified patent and that said Letters Patent are hereby corrected as shown below:

Column 2, line 28, after "define" should be inserted --annular protuberances or--. Column 2, line 58, "Where" should read --Were--. Column 2, line 67, "depression" should read --depressions--. Column 3, line 11, "longer" should read --larger--. Column 3, line 26, "jont" should read --joint--. Column 3, lines 28-29, "ulrasonic" should read --ultrasonic--. Column 3, line 36, "32" should read --(32)--. Column 4, line 36, after "before" should be inserted --the--. Column 4, line 43, "an" should read --and--. Column 4, line 47, "An object" should read --A can--. Column 4, line 50, "bein" should read --being--. Column 4, line 64, "said" , second occurrence, should read -- each --. Column 6, line 14, "9" should read -- 4 --. Column 6, line 27, "in" should be the start of a new paragraph.

Signed and Sealed this

*twenty-ninth* Day of *June 1976*

[SEAL]

*Attest:*

RUTH C. MASON
*Attesting Officer*

C. MARSHALL DANN
*Commissioner of Patents and Trademarks*